United States Patent [19]

Yoshida et al.

[11] Patent Number: 4,526,663

[45] Date of Patent: Jul. 2, 1985

[54] METHOD FOR ELECTROLYSIS OF AQUEOUS ALKALI METAL CHLORIDE SOLUTION

[75] Inventors: Mitsuo Yoshida; Hiroyoshi Matsucka; Hajime Munekuni, all of Nobeoka, Japan

[73] Assignee: Asahi Kasei Kogyo Kabushiki Kaisha, Osaka, Japan

[21] Appl. No.: 295,389

[22] Filed: Aug. 24, 1981

Related U.S. Application Data

[63] Continuation of Ser. No. 157,163, Jun. 6, 1980, abandoned.

[30] Foreign Application Priority Data

Jun. 7, 1979 [JP] Japan ..... 54-70544
Jun. 7, 1979 [JP] Japan ..... 54-70545

[51] Int. Cl.[3] ..... C25B 1/34

[52] U.S. Cl. ..... 204/98; 204/128; 204/283; 204/296

[58] Field of Search ..... 204/98, 128, 296, 283

[56] References Cited

U.S. PATENT DOCUMENTS

| | | | |
|---|---|---|---|
| 4,039,409 | 8/1977 | La Conti et al. | 204/98 |
| 4,101,395 | 7/1978 | Motani et al. | 204/98 |
| 4,111,779 | 9/1978 | Seko et al. | 204/98 |
| 4,178,218 | 12/1979 | Seko | 204/98 |
| 4,191,618 | 3/1980 | Coker et al. | 204/98 |
| 4,204,920 | 5/1980 | Kurtz et al. | 204/98 |
| 4,210,501 | 7/1980 | Dempsey et al. | 204/98 |

FOREIGN PATENT DOCUMENTS

| | | | |
|---|---|---|---|
| 52297 | of 1978 | Japan | 204/98 |
| 1735 | of 1979 | Japan | 204/98 |
| 1120267 | 7/1968 | United Kingdom | 204/128 |
| 1401290 | 7/1975 | United Kingdom | 204/128 |
| 1435477 | 5/1976 | United Kingdom | 204/128 |
| 1480538 | 7/1977 | United Kingdom | 204/98 |
| 1503799 | 3/1978 | United Kingdom | 204/98 |
| 1530680 | 11/1978 | United Kingdom | 204/98 |
| 2007260 | 5/1979 | United Kingdom | 204/98 |
| 2009792 | 6/1979 | United Kingdom | 204/128 |
| 2009795 | 6/1979 | United Kingdom | 204/128 |
| 2010908A | 7/1979 | United Kingdom | 204/128 |
| 2028371A | 3/1980 | United Kingdom | 204/128 |
| 2032458A | 5/1980 | United Kingdom | 204/128 |

OTHER PUBLICATIONS

Webster International Dictionary, 2nd ed., p. x.

*Primary Examiner*—R. L. Andrews
*Attorney, Agent, or Firm*—Birch, Stewart, Kolasch & Birch

[57] ABSTRACT

The electrolysis of an aqueous alkali metal chloride solution in electrolytic cells of the type having anode compartments and cathode compartments separated by a cation-exchange membrane is performed with improved efficiency by positioning and maintaining the cathodes in intimate contact with one entire surface of the cation-exchange membranes and the porous anodes in as close as possible proximity to the other surface of the membranes.

2 Claims, 4 Drawing Figures

METHOD FOR ELECTROLYSIS OF AQUEOUS ALKALI METAL CHLORIDE SOLUTION

This application is a continuation of copending application Ser. No. 157,163, filed on June 6, 1980, now abandoned.

BACKGROUND OF THE INVENTION

This invention relates to a novel method for the electrolysis of an aqueous alkali metal chloride solution by use of a cation-exchange membrane. More particularly, the invention is directed to a method for the manufacture of an alkali hydroxide by the electrolysis of a corresponding alkali metal chloride solution in electrolytic cells of the type having anode compartments and cathode compartments separated by a cation-exchange membrane, which method is characterized by having the cathodes positioned and maintained in intimate contact with one surface of the cation-exchange membranes and the anodes in as close proximity as possible to the other surface of the membranes.

The process for the electrolysis of alkali metal chlorides by use of cation-exchange membranes has overcome conventional technical drawbacks and has attained growth as a novel energy-saving approach. Among the salient advantages of this process are the preclusion of the possibility of environmental pollution owing to the disuse of mercury and asbestos, the production of caustic soda of high purity owing to the ability of the cation-exchange membranes to prevent diffusive passage of NaCl from the anode compartments to the cathode compartments, and the liberation of chlorine gas and hydrogen gas both of high purity owing to the perfect separation of the anode compartments and cathode compartments by the intervening cation-exchange membranes. This process is said to have already surpassed the mercury process and the diaphragm process in terms of the total energy cost embracing both steam and electricity.

Need is nevertheless felt for the development of techniques which permit further reduction in the cost of electricity because the proportion of the cost of electricity in the relative production cost is so high to approach the order of 40% in Japan.

Approaches offered for reducing the distances between the anodes and cathodes and consequently reducing the volumes of gases ocurring around the electrodes are effective in lowering voltages involved. Such methods are disclosed in Japanese published unexamined patent application Nos. 80974/1975 and 109899/1975, for example. With these methods, however, although the distance between the anodes and ion-exchange membranes are indeed small, the distances between the cathodes and ion-exchange membranes are still large and the reduction in voltages is not sufficient.

With a view to shortening the distances between the cathodes and ion-exchange membranes, Japanese published unexamined patent application No. 17375/1979 suggests an idea of filling a lot of granular electric conductors between the cathode and the membrane and causing the granular substances to function as cathodes. This method, however, suffers from a disadvantage that heavy contact resistance occurs between the adjoining individual granules and between the granules and the cathode.

Japanese published unexamined patent application No. 47877/1979 teaches a method of mechanically pressing the anodes and cathodes into intimate contact with the ion-exchange membranes with the force such as of springs. Although this method is free from the disadvantage of heavy contact resistance suffered by the method of Japanese published unexamined patent application No. 17375/1979, it is not allowed to obtain an appreciable reduction in the inter-electrode distances owing to the limits to the fabricative precision of electrodes. Inevitably, therefore, the reduced distances average 1 mm and, at times, increase to the order of 2 mm.

Electrolytic systems using still smaller interelectrode distances have been suggested by Japanese published unexamined patent application Nos. 78788/1977 and 52297/1978. In these systems, anodes are embedded in one surface of the membranes and cathodes in the other surface of the membranes. According to these methods, since the inter-electrode distances equal the thicknesses of the ion-exchange membranes, the systems applied to the electrolysis of alkali metal chlorides are expected to afford reduction in voltages involved. They nevertheless entail the disadvantages: (1) Although the electrolytic voltage is low where the current density falls in the range of low levels, it tends to increase as the current density rises. (2) The current efficiency also tends to decrease as the current density rises. (3) The oxygen gas content in the chlorine gas is greater than in the operation by the conventional method. With the conventional method, the oxygen content is generally below 1%, whereas with the methods under discussion, it is as high as several %. Particularly when the current density is increased, this value aburptly increases possibly to surpass the level of 10%. This increase in the oxygen content deprives the ion-exchange electrolytic process of one of its characteristic features. (4) Use of expensive devices as the current collectors on the anode side is inevitable and the resistance loss in the current collectors is large. (5) The systems are difficult to apply to commercial-scale multi-electrode electrolytic cells. When they are incorporated in such multi-electrode electrolytic cells possessed of explosion-bonded partition walls as disclosed by Japanese published unexamined patent application No. 43377/1976 with a view to lowering the resistance loss within the current collectors, the gasket must be given a properly adjusted thickness so that the current collectors come into contact with the anodes and cathodes embedded in the opposite surfaces of the cation-exchange membranes and not inflict a wound upon the membranes. From the practical point of view, therefore, such adjustment proves extremely difficult.

SUMMARY OF THE INVENTION

With a view to solving the various problems mentioned above and, therefore, establishing a method which permits the electrolysis to be performed more advantageously under harsh conditions than the conventional methods, the inventors made an elaborate study on the various effects of the intimate contact between the electrodes and membranes under varying conditions. It has been consequently found that the merit of the intimate contact between the anode and membranes is extremely meager contrary to expectation, whereas the effect of the intimate contact between the cathodes and membranes is conspicuous. The invention relies on this discovery. The gist of this invention, therefore, consists in a method which is characterized by having only the cathodes positioned and maintained in intimate contact with the cation-exchange membranes and allowing the anodes to be positioned and maintained not in direct contact with but in as close proximity to the membranes as possible. The invention finds it particularly desirable for the cation-exchange membranes and the cathodes to be fastened into one-piece wholes.

DETAILED DESCRIPTION OF THE INVENTION

Figure 2:
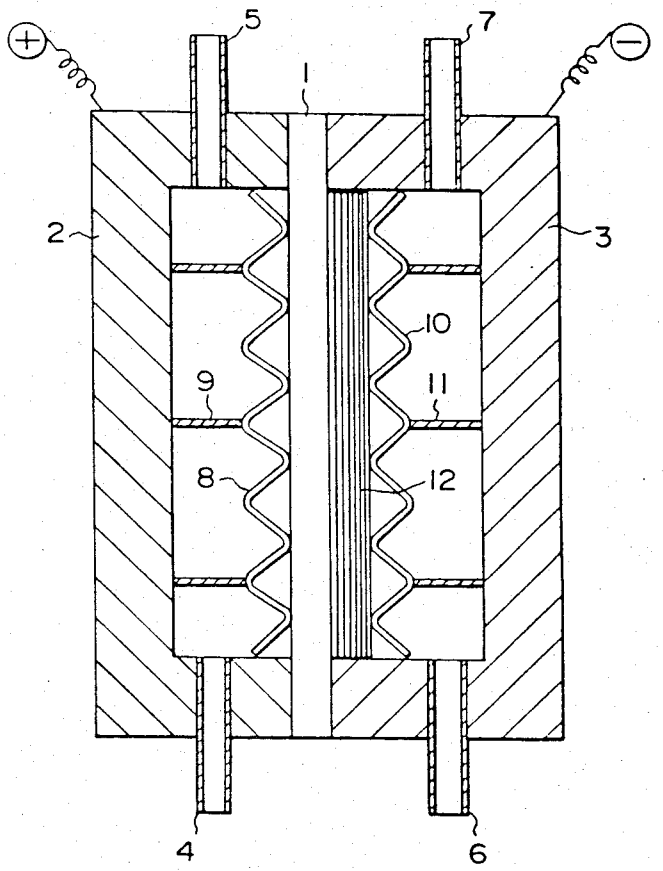
FIG. 1 and FIG. 2 are cross sections of typical electrolytic cells to be used in putting this invention to effect.

According to this invention, not only the voltage drop is accomplished under normal electrolytic conditions but also the alkali electrolysis is obtained with the current efficiency at a high level and the oxygen content in the chlorine gas at a low level even when the current density is so high as to exceed 20 A/dm$^2$, for example.

One probable reason for the manifestation of this advantageous effect is that the manner in which the gases issuing from the electrolysis adhere to the ion-exchange membrane differs on the anode side (chlorine gas) and on the cathode side (hydrogen gas). It is generally held that the gases adhering to the ion-exchange membrane intercept the flow of electric current and increase the thickness of the diffusion layer on the membrane surface to the extent of inducing a voltage rise. A close observation of the manner in which the chlorine gas and oxygen gas adhere to the membrane, however, reveals a clear difference between the two surfaces of gas adhesion. Specifically, the adhesion of the former gas is substantially negligible and that of the latter gas is notable. It may be possibly for this reason that the voltage drop is greater when the intimate contact is established between the cathode and the membrane than when it is established between the anode and the membrane.

The reason for the disadvantage involved in the intimate contact of the anode across the entire surface of the membrane, i.e. the rise of voltage and the fall of current efficiency at an increased current density, may possibly be that the amount of chlorine ions delivered to the anode surface is rather insufficient so as to induce decomposition of water. In addition to the reason just given, the fact that the proportion of the $OH^-$ ions which are back migrated from the cathode compartments and which escape being thoroughly neutralized and directly discharge electrons at the anodes is extremely large may possibly be responsible for the other advantage, namely, the increased oxygen gas content in the formed chlorine gas.

In contrast, the present invention still enjoys the merit of the ion-exchange electrolytic method, namely the low oxyen content in the chlorine gas because the chloride ions, one of the main reactants, are amply supplied and further because the back-migrated $OH^-$ ions are allowed to react with hydrogen ions and chlorine gas before completion of their travel for the membrane interiors to the anodes and, therefore, the proportion of the $OH^-$ ions available to discharge electrons directly at the anodes is decreased.

Now, the present invention will be described in detail with reference to preferred embodiments thereof.

To this end, the method adopted for establishing the intimate contact between the cathodes and the ion-exchange membranes throughout the entire surfaces thereof is not critical in any specific aspect. One method available therefor involves establishing the intimate contact by pressing structurally resilient cathodes against cation-exchange membranes. Specifically, such cathodes are obtained by applying a structurally resilient corrugated metal gauze of plain weave or twill weave construction, spring or wire-mesh demister to one surface of porous supporting plates such as, for example, expanded metal sheets, perforated metal sheets or lattice-like metal nets. When the composites thus formed are pressed in the direction of their overlaid sides against the cation-exchange membranes, since the overlays have resilience and, therefore, are allowed to come into ample contact with the surfaces of the membranes, the electric current is collected in the porous supporting plates via the surfaces of the cathodes, namely the overlays which are held in intimate contact with the membranes.

A more desirable method available consists in having cation-exchange membranes and cathodes fastened into one-piece wholes. Although no particular limits are placed upon the method to be adopted for fastening the cation-exchange membranes and cathodes throughout their entire opposed surfaces, the most desirable method entails effecting this fastening by embedding cathodic materials in the surfaces of the cation-exchange membranes. Specifically, such integration of the cation-exchange membrane and cathode is obtained by uniformly and densely spreading on the cathode side surface of the cation-exchange membrane a powdered substance such as, for example, platinum black, powdered nickle or powdered iron which is generally used as a cathode in a caustic alkali, optionally in a form mixed with powdered polytetrafluoroethylene, for example, putting the membrane between two rigid plates such as of stainless steel interposing resilient members such as of silicone rubber therebetween and applying pressure and heat inwardly from the opposite rigid plates thereby fastening the cathode and the cation-exchange membrane into one-piece whole. Alternatively, the integration may be effected by compressing in a heat press a powdered substance such as, for example, platinum black, powdered nickel or powdered iron which is generally used as a cathode in a caustic alkali, in conjunction with an added binder such as polytetrafluoroethylene thereby producing, in advance, membranous pieces, and thereafter compressing the membranous pieces and cation-exchange membranes together to fasten them into one-piece wholes.

Among the other methods available for the purpose of this integration are the method which applies cathodes to the cathode side surfaces of the cation-exchange membranes by the chemical plating technique and the method which deposits cathodes on the same surfaces by the vacuum evaporation technique, for example. In this case, an added effect is obtained by using as current collectors the aforementioned porous supporting plates overlaid by resilient coats, namely the composites obtained by applying a structurally resilient corrugated metal gauze of plain weave or twill weave construction, spring or wire-mesh demister to one side surfaces of porous supporting plates such as, for example, expanded metal sheets, perforated metal sheets or lattice-like metal nets. When the composites are pressed in the direction of their overlaid side against the cation-exchange membranes, they are allowed by the resilience of the overlays to come into ample contact with the membranes, with the result that the electric current is collected in the porous supporting plates via the resilient overlays from the cathodes embedded in the surfaces of the membranes.

It is desirable that the porous supporting plates and the resilient overlays are joined by fusion. Otherwise, the contact resistance generated between the porous supporting plates and resilient overlays is high so as to lower the effect of voltage drop.

The porous supporting plates may be made of any common material such as stainless steel or nickel which is generally accepted for use in caustic alkalis. When the thickness falls in the range of about 1 to 3 mm, the resistance loss is negligibly small. The overlays are formed of such material as iron, stainless steel or nickel. For the metal wires forming nets, etc. in the overlays to keep desired resilience, they are desired to have a diameter in the range of from 0.1 to 0.5 mm.

For the purpose of the invention, anodes of the type produced by coating porous plates (such as, for example, expanded metal sheets) of valve metal such as titanium, tantalum or niobium with a platinum metal, the oxide of a platinum metal, a mixture of the oxide of a platinum metal with the oxide of other metal or an oxygen-containing solid solution of a platinum metal and other metal are used advantageously.

No specific limits are placed on the kind of cation-exchange membrane to be used in the invention. Any of the cation-exchange membranes which are generally accepted for use in the electrolysis of alkali metal chlorides can be used. The ion-exchange group incorporated in the membrane may be of sulfonic acid form, carboxylic acid form, sulfonic acid amide form or any other form. The carboxylic acid form or the combination of carboxylic acid form and sulfonic acid form which provides a high sodium transport number proves to be most suitable. In the case of the membranes using this combination form, it is most desirable for the membrane to be disposed in such a manner that the side containing the sulfonic acid group will fall on the anode side surface and the side containing the carboxylic acid group on the cathode side surface respectively of the membrane.

As the matrix for the membrane, the fluorocarbon type resin proves to be an excellent choice in terms of the resistance to chlorine. The matrix may be lined with cloth or net for improved strength.

The current density with which the invention is put to effect can be selected in a wide range of from 1 to 70 $A/dm^2$. Particularly, the effect of this invention manifests itself conspicuously when the operation of the invention is carried out at a high current density of not less than 20 $A/dm^2$.

The concentration of the alkali metal chloride in the feed solution to the anode compartment can be varied in a wide range of from 100 g/lit. to 300 g/lit. A lower concentration results in a rise of the voltage, a fall of the current efficiency and an increase in the oxygen gas content of the chlorine gas. A higher concentration results in an increase in the alkali metal chloride content of the alkali hydroxide produced in the cathode compartment and a fall of the utilization ratio of the alkali metal chloride. The preferred range is from 140 g/lit. to 200 g/lit.

The pH value of the anolyte can be varied in a wide range of from 1 to 5.

The concentration of alkali hydroxide in the catholyte can be adjusted in a wide range of from 15 to 45% by weight.

Figure 1:
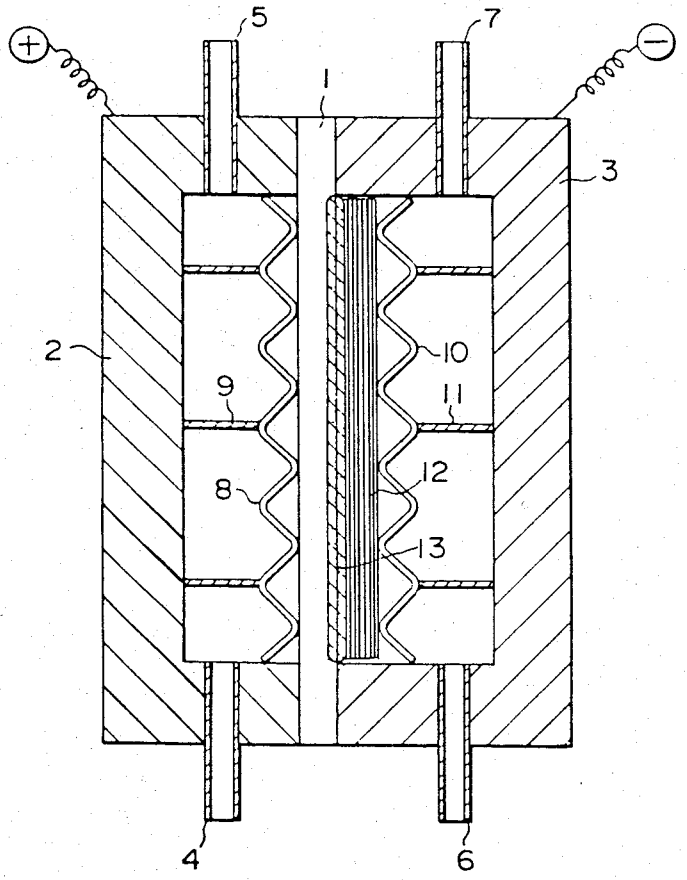

The construction of electrolytic cells to be used in the present invention will be described in detail with reference to the accompanying drawing. FIG. 1 illustrates a typical electrolytic cell to be used for the invention.

In a cation-exchange membrane 1, a cathodic substance such as, for example, platinum black 13 is embedded. An anode compartment frame 2 is made of titanium, for example, and is provided with a feed nozzle 4 and a discharge nozzle 5 for the anolyte. A cathode compartment frame 3 is made of steel, for example, and is provided with a feed nozzle 6 and a discharge nozzle 7 for the catholyte. An anode 8 formed by coating an expanded sheet of titanium with an anodically active substance is welded to an anode compartment frame 2, through the medium of ribs 9. An porous supporting plate 10 made of steel is welded to the cathode compartment frame 3 through the medium of ribs 11. Denoted by 12 is a current collector which comprises a resilient overlay formed of a wire-mesh demister, for example.

FIG. 2 illustrates another typical electrolytic cell to be used for the invention. In the diagram, the numeric symbols correspond to those of FIG. 2. In this embodiment, no cathodic substance is embedded in the cation-exchange membrane and the resilient overlay 12 functions as the cathode in the electrolysis.

The resilience of the resilient overlay 12 lends itself to keeping the cation-exchange membrane 1 against the anode 3 and also bringing the cation-exchange membrane 1 or cathodic substance 13 into intimate contact with the resilient overlay 12.

Figure 3:
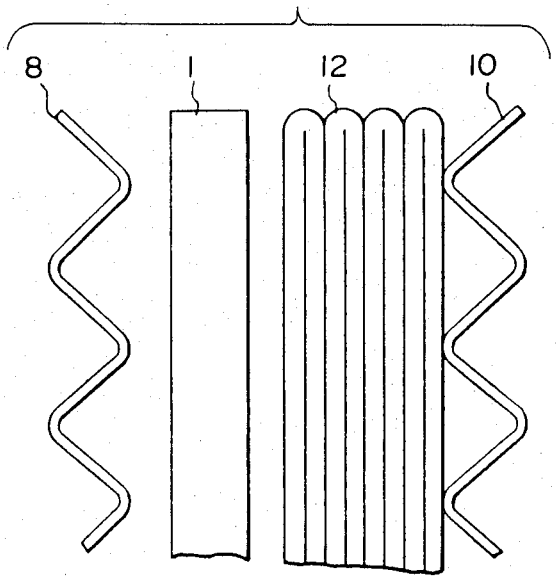
FIG. 3 is a model diagram showing the positional relationship between the cation-exchange membrane and the electrodes before application of pressure thereto.
Figure 4:
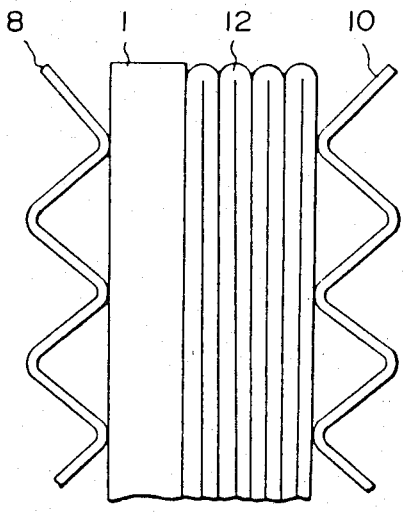
FIG. 4 is a model diagram showing the positional relationship between the cation-exchange membrane and the electrodes after application of pressure thereto.

FIG. 3 and FIG. 4 show the positional relationship among the anode 3, cation-exchange membrane 1, resilient overlay 12 and porous supporting plate 10 before and after application of pressure thereto, with FIG. 3 showing the relationship before application of the pressure and FIG. 4 the relationship after application of the pressure.

Upon application of the pressure, the resilient overlay 12 is compressed, the cation-exchange membrane pressed against the anode and the cation-exchange membrane brought into intimate contact with the resilient overlay.

Since the cathode is in the form of a resilient overlay such as of a wire-mesh demister, it is allowed to come into intimate contact with the cation-exchange membrane throughout the entire surface thereof. The anode, however, is a porous plate such as an expanded sheet. The anode, therefore, is not brought into intimate contact with the cation-exchange membrane through the entire surface thereof but is positioned in close proximity to the cation-exchange membrane and utilized for keeping the membrane in position.

PREFERRED EMBODIMENT

EXAMPLE 1

A cation-exchange membrane described in Example 6 of the specification of British Patent No. 1,497,748 was boiled in an aqueous 0.1N caustic soda solution for one hour. Then, platinum black was spread on one side of the membrane at a rate of 0.5 gr. per $dm^2$ of the membrane surface, two silicone rubber sheets were set fast against the opposite sides of the membrane, and two stainless steel nets were placed fast on the outer sides of the rubber sheets. The resultant sandwich was pressed in a heating press under the conditons of 12 $kg/cm^2$ and 180° C. for five minutes.

An electrolytic cell illustrated in FIG. 1 was formed by using the cation-exchange membrane prepared as described above. The cell had an area of 10 cm×10 cm available for passage of the electric current.

A cathode current collector for use in the cell was obtained by welding three wire-mesh demisters made of SUS 304 wires (0.3 mm in diameter) to a porous supporting plate having circular holes (3 mm in diameter) bored in an iron sheet (1.5 mm in thickness) at an aperture ratio of 60%. An anode for use in the cell was obtained by coating an expanded sheet prepared from a titanium plate (1.5 mm in thickness) with ruthenium oxide.

When this electrolytic cell was operated to effect electrolysis at a current density of 30 $A/dm^2$ at 90° C. with brine of 3N in sodium chloride concentration and pH 2 in hydrogen ion concentration fed to the anode compartment and an aqueous 33% (by weight) caustic soda solution fed to the cathode compartment, the current efficiency was 93%, the voltage 4.0 V and the oxygen gas content of the chlorine gas was 0.4% by volume.

EXAMPLE 2

An electrolytic cell of the construction of FIG. 2 was formed by using a cation-exchange membrane described in Example 6 of the specification of British Pat. No. 1,497,748. This cell had an area of 10 cm×10 cm available for passage of the electric current.

A cathode for use in this cell was obtained by welding three wire-mesh demisters made of SUS 304 wires (0.3 mm in diameter) to a porous supporting plate having circular holes (3 mm in diameter) bored in an iron sheet (1.5 mm in thickness) at an aperture ratio of 60%.

An anode for use in the cell was obtained by coating an expanded sheet prepared from a titanium plate (1.5 mm in thickness) with ruthenium oxide.

When the cell was operated under the same conditions as those of Example 1 to effect electrolysis, the current efficiency was 93%, the voltage 4.05 V and the oxygen gas content of the chlorine gas 0.4% by volume.

COMPARISON EXAMPLE 1

An anode and cathode were both embedded in a cation-exchange membrane, and electrolysis was conducted with both the anode and cathode held in intimate contact with the cation-exchange membrane throughout the entire surfaces, thereof.

In the same manner as in Example 1, platinum black was spread on one side of the same cation-exchange membrane as used in Example 1 at a ratio of 0.5 gr. per $dm^2$ of the membrane surface and ruthenium oxide powder on the other side of the membrane at a ratio of 0.4 gr. per $dm^2$ of the membrane to effect embedment of the electrodes.

An electrolytic cell of the construction similar to that of Example 1 was formed by using the membrane prepared as described above. In this case, a metal net formed of platinum wires (0.2 mm in diameter) was interposed between an expanded titanium sheet coated with ruthenium oxide and the cation-exchange membrane and was used as an anode current collector.

When the cell was operated under the same conditions as those of Example 1 to effect electrolysis, the current efficiency was 90%, the voltage 4.2 V and the oxygen gas content of the chlorine gas 4.0% by volume.

COMPARISON EXAMPLE 2

Electrolysis was carried out with an anode and cathode not held in intimate contact with a cation exchange membrane.

The same cation-exchange membrane as used in Example 1, in a form having neither platinum black nor ruthenium oxide powder embedded therein, was used to make an electrolytic cell of the construction similar to that of Example 1. In this case, a wire-mesh demister was erected at a distance of 2 mm from the cation-exchange membrane and was used as an anode.

When the cell was operated under the same conditions as those of Example 1 to effect electrolysis, the current efficiency was 93%, the voltage 4.15 V and the oxygen gas content of the chlorine gas 0.4% by volume.

EXAMPLE 3

In the same manner as in Example 1, platinum black was spread for embedment in the surface, having an equivalent weight 1500, of the cation-exchange membrane "Nafion 315" made by DuPont.

An electrolytic cell of the construction similar to that of Example 1 was formed by using the cation-exchange membrane prepared as described above. In this case, a cathode current collector used in the cell was obtained by welding a spring of stainless steel wire (0.8 mm in diameter) to a porous supporting plate comprising an expanded sheet prepared from an iron plate (1.5 mm in thickness).

When this electrolytic cell was operated to effect electrolysis at a current density of 40 $A/dm^2$ at 90° C. with an aqueous 17% (by weight) caustic soda solution fed to the cathode compartment and brine of 3N in sodium chloride concentration and pH 2 in hydrogen ion concentration to the anode compartment, the current efficiency was 82%, the voltage 3.70 V and the oxygen gas content of the chlorine gas 0.5% by volume.

EXAMPLE 4

An electrolytic cell of the construction of FIG. 2 was formed by using a cation-exchange membrane "Nafion 315" made by DuPont, with the membrane surface of an equivalent weight 1500 falling on the cathode compartment side.

The same anode as used in Example 1 was used.

A cathode for use in the cell was obtained by welding one wire-mesh demister made of nickel wires (0.3 mm in diameter) to a porous supporting plate comprising an expanded sheet prepared from an iron plate (1.5 mm in thickness). When the electrolytic cell was operated under the same conditions as those of Example 3 to effect electrolysis, the current efficiency was 82%, the voltage 3.70 V and the oxygen gas content of the chlorine gas 0.5% by volume.

COMPARISON EXAMPLE 3

In the same manner as in Comparison Example 1, platinum black was spread in the surface, having an equivalent weight 1500, of the same cation-exchange membrane as used in Example 3 and ruthenium oxide powder in the surface, having an equivalent weight 1100, of the same membrane.

An electrolytic cell of the construction similar to that of Comparison Example 1 was formed by using the cation-exchange membrane prepared as described above. But the cathode current collector used in the cell was the same as that used in Example 3.

When the electrolytic cell was operated under the same conditions as those of Example 3 to effect electrolysis, the current efficiency was 78%, the voltage 3.85 V and the oxygen gas content of the chlorine gas 8% by volume.

EXAMPLE 5

Tetrafluoroethylene and perfluoro-3,6-dioxy-4-methyl-7-octene-sulfonyl fluoride were copolymerized in 1,1,2-trichloro-1,2,2-trifluoroethane in the presence of perfluoropropionyl peroxide as the polymerization initiator, with the polymerization temperature kept at 45° C. to produce a copolymer having an equivalent weight (weight of the dry resin of the amount containing one equivalent of ion-exchange group) of 1350 (Polymer 1) and a copolymer having an equivalent weight of 1090 (Polymer 2). The equivalent weight of each polymer was determined by washing the polymer with water, saponifying the washed polymer and subjecting the saponified polymer to titration. These two polymers were thermally fused into a two-layer laminate containing a layer (Polymer 1) of 35 microns and a layer (Polymer 2) of 100 microns. Then a woven fabric of Teflon ® was embedded in the laminate from the Polymer 2 side by the vacuum lamination technique. This laminate was saponified to produce a sulfonic acid form cation-exchange membrane. Only the Polymer 1 side of this membrane was converted to a sulfonyl chloride form and then converted into a carboxylic acid form through a reducing treatment (Side A). Further, the carboxylic acid group was converted to a carboxylic ester.

A mixture of platinum black (3 g/dm$^2$) with Teflon (Trade name) powder (23% by weight) was preliminarily pressed in a heating press under the conditions of 360° C. and 180 kg/cm$^2$. Thereafter, the pressed mixture was applied to Side A of the cation-exchange membrane under the conditions of 310° C. and 40 kg/cm$^2$ for eight minutes, to form a cathode.

An electrolytic cell of the construction similar to that of Example 1 was formed by using the cation-exchange membrane prepared as described above. A cathode current collector for use in this cell was obtained by intimately joining six expanded sheets prepared from SUS 304 plates (0.1 and 0.2 mm in thickness) to a perforated plate having circular holes (3 mm in diameter) bored in a plate of SUS 304 (3 mm in thickness) at an aperture ratio of 60%. The anode used in the cell was the same as that of Example 1.

When the electrolytic cell was operated to effect electrolysis at a current density of 40 A/dm$^2$ at 90° C. with brine of 3N in sodium chloride concentration and pH 2 in hydrogen ion concentration fed to the anode compartment and an aqueous 21% (by weight) caustic soda solution to the cathode compartment respectively, the current efficiency was 96% , the voltage 3.65 V and the oxygen gas content of the chlorine gas 0.3% by volume.

EXAMPLE 6

An electrolytic cell of the construction similar to that of Example 2 was formed by using the same cation-exchange membrane as used in Example 5, with the carboxylic acid layer side of the membrane facing the cathode compartment. When the electrolytic cell was operated to effect electrolysis under the same conditions as those of Example 5, the current efficiency was 96%, the voltage 3.70 V and the oxygen gas content of the chlorine gas 0.3% by volume.

COMPARISON EXAMPLE 4

In the Polymer 2 side of the same cation-exchange membrane as used in Example 5, ruthenium oxide powder (0.4 gr./dm$^2$) was embedded, too, by the same manner and at the same time that the cathodic substance was embedded on the other side of the membrane, to produce an anode. Thereafter, the membrane was subjected to the same after-treatment as in Example 5. With the cation-exchange membrane thus prepared, electrolysis was conducted under the same conditions as those of Example 5. The anode current collector used in the electrolytic cell was the same as that of Comparison Example 1. In this electrolysis, the current efficiency was 92%, the voltage 3.9 V and the oxygen gas content of the chlorine gas 3% by volume.

EXAMPLE 7

In the same manner as in Example 5, the mixture of platinum black and Teflon powder was embedded in the surface having an equivalent weight 1500 of the cation-exchange membrane "Nafion 315" made by DuPont. An electrolytic cell of the construction similar to that of Example 5 was formed by using the cation-exchange membrane prepared as described above. When this electrolytic cell was operated to effect electrolysis under the same conditions as those of Example 3, the current efficiency was 82%, the voltage 3.65 V and the oxygen gas content of the chlorine gas 0.5% by volume.

For comparison, ruthenium oxide powder was embedded in the surface having an equivalent weight 1100 of the cation-exchange membrane by the same manner and at the same time that the cathodic substance was embedded on the other side of the membrane, to form an anode. The anode current collector used in the cell was the same as that used in Comparison Example 1. With the cation-exchange membrane prepared as described above, electrolysis was carried out under the same conditions as those described above. In this electrolysis, the current efficiency was 78%, the voltage 3.8 V and the oxygen gas content of the chlorine gas 8% by volume.

EXAMPLE 8

A cation-exchange membrane "Nafion 315" made by DuPont was treated in an aqueous 5N hydrochloric acid solution to have the exchange group converted into sulfonic acid and then was boiled in purified water for one hour. Thereafter, an aqueous 3% chloroplatinic acid solution was incorporated in the side having an equivalent weight 1500 and an aqueous 10% hydrogenated sodium borate solution in the side having an equivalent weight 1100. The membrane was left to stand at 70° C. for five hours so that platinum black was reduced as a cathode in the side having an equivalent weight 1500 of the cation-exchange membrane. An electrolytic cell of the construction similar to that of Example 5 was formed by using the cation-exchange membrane. When this elctrolytic cell was operated to effect electrolysis under the same conditions as those of Example 3, the current efficiency was 81%, the voltage 3.7 V and the oxygen gas content of the chlorine gas 0.6% by volume.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. In a process for the electrolysis of an aqueous alkali metal chloride solution in an electrolytic cell divided by a cation-exchange membrane, through which neither liquid nor gas can substantially pass, into an anode compartment and a cathode compartment, respectively, to produce alkali metal hydroxide and discharging hydrogen gas and chlorine gas from the cathode compartment and the anode compartment, respectively, the improvement which comprises utilizing a cathode which is joined with said cation-exchange membrane throughout one entire side surface thereof wherein said cation-exchange membrane has a powdered cathodic substance uniformly and densely embedded in the cathode side surface of the membrane and positioning and maintaining an anode of porous construction in close proximity to but not in contact with the other side surface of the membrane through which neither liquid nor gas can substantially pass wherein electrolysis is carried out at a high current density of not less than 20 $A/dm^2$, the concentration of alkali hydroxide in the catholyte is maintained in a range of from 15 to 45% by weight and wherein the oxygen gas content of the chlorine gas is not more than 0.6% by volume.

2. The process according to claim 1 wherein said cation-exchange membrane is a fluorocarbon polymer membrane having carboxylic acid groups in one side surface and sulfonic acid groups in the other side surface, said cathode being positioned and maintained in intimate contact with the side surface containing said carboxylic acid groups.

* * * * *